US009155941B2

(12) United States Patent
Lorhpipat

(10) Patent No.: US 9,155,941 B2
(45) Date of Patent: Oct. 13, 2015

(54) TAKRAW BALL

(71) Applicant: Satian Industries Co. Ltd., Sampran Nakhonpathon (TH)

(72) Inventor: Boonchai Lorhpipat, Sampran Nakhonpathon (TH)

(73) Assignee: Satian Industries Co. Ltd., Sampran Nakhonpathon (TH)

( * ) Notice: Subject to any disclaimer, the term of this patent is extended or adjusted under 35 U.S.C. 154(b) by 0 days.

(21) Appl. No.: 14/349,589

(22) PCT Filed: Oct. 3, 2012

(86) PCT No.: PCT/EP2012/069545

§ 371 (c)(1),
(2) Date: Apr. 3, 2014

(87) PCT Pub. No.: WO2013/050423

PCT Pub. Date: Apr. 11, 2013

(65) Prior Publication Data

US 2014/0248980 A1 Sep. 4, 2014

(30) Foreign Application Priority Data

Oct. 4, 2011 (GB) ..... 1117043.8

(51) Int. Cl.
*A63B 39/00* (2006.01)

(52) U.S. Cl.
CPC ..... *A63B 39/00* (2013.01); *A63B 2039/003* (2013.01)

(58) Field of Classification Search
CPC ... A63B 39/00; A63B 2039/003; A63B 38/06
See application file for complete search history.

(56) References Cited

U.S. PATENT DOCUMENTS

| | | | | |
|---|---|---|---|---|
| 5,224,959 | A * | 7/1993 | Kasper | 473/612 |
| 5,566,937 | A * | 10/1996 | Lorhpipat et al. | 473/612 |
| 2004/0134136 | A1* | 7/2004 | Shearing | 52/81.2 |
| 2004/0172888 | A1* | 9/2004 | Shearing | 52/81.1 |
| 2007/0254754 | A1* | 11/2007 | Lorhpipat et al. | 473/612 |
| 2014/0248980 | A1* | 9/2014 | Lorhpipat | 473/612 |

FOREIGN PATENT DOCUMENTS

| | | | |
|---|---|---|---|
| GB | 2196861 | A * | 5/1988 |
| WO | 2006051248 | A1 | 5/2006 |

OTHER PUBLICATIONS

International Search Report for PCT Application No. PCT/EP2012/069545 (3 pages).
Written Opinion for PCT Application No. PCT/EP2012/069545 (3 pages).

* cited by examiner

*Primary Examiner* — Steven Wong
(74) *Attorney, Agent, or Firm* — Sutherland Asbill & Brennan LLP

(57) ABSTRACT

A takraw ball side strip (2) comprising an elongate length of plastics material having one side edge of sinusoidally undulating profile having troughs (7) and peaks (6), wherein the strip (2) is shaped or otherwise constructed to be preferentially flexible in peak regions (20) whereby, when the strip (2) is joined by its ends into a hoop (30), peak regions (20) will bend more readily than other regions of the strip. Also disclosed is A takraw ball woven from side strips as described, a more flexible peak region (20) of one strip (20*a*) may be positioned to overlie a less flexible strip region (34), located between a peak region (20) and a trough (7), of an underlying strip (20*b*).

8 Claims, 10 Drawing Sheets

TAKRAW BALL

CROSS-REFERENCE TO RELATED APPLICATIONS

This application claims the priority benefit of PCT/EP2012/069545, filed on Oct. 3, 2012, designating the United States, and claiming priority to European Patent Application No. 1117043.8 filed Oct. 4, 2011. The contents of these applications are hereby incorporated by reference in their entirety.

FIELD OF THE INVENTION

This invention relates to takraw balls and it particularly relates to an improved method of manufacturing takraw balls.

BACKGROUND

Sepak Takraw is played by opposing teams passing a takraw ball across a chest-high net using feet, knees, head, shoulders etc., i.e. every part of the body except the player's hands and arms. The object of the game is to ground the ball in the opposing team's court; the rules of the game are similar to volleyball. Another form of takraw is hoop takraw, only one team plays at a time and the players co-operate to get the ball into a vertically orientated hoop some 5 meters above the ground.

PRIOR ART

Document GB 2196861 A (11 May 1988—Boonchai Lorhpipat) describes the manufacture of traditional takraw balls by conventionally weaving split rattan strips into a spherical basket and the manufacture of takraw balls by weaving strips of plastics material into interwoven hoops.

More particularly and as described in GB 2196861, with reference to the drawings wherein FIG. 1 shows a Thai takraw ball and FIGS. 2, 3 and 4 are, respectively, a plan, an underplan and a side elevation of a side strip for the ball of FIG. 1. Such a prior art takraw ball is manufactured by the steps of:

weaving strips (2) and (3) into a spherical basket (1) and joining the ends of each woven strip into a hoop, each strip being formed of an elongate, generally flat length (4) of plastics material having one convex side edge (5) of constant radius and the other side edge of sinusoidally undulating profile having troughs (7) and peaks (6), the hooped strip assuming a frusto-conical shape with the convex side edge in a diametral plane.

arranging pairs of hooped strips (2) with the strip convex sides edges (5) opposed in a common plane and the sinusoidal sides edges relatively staggered so that interwoven hooped strips cross-over at troughs (7) of the sinusoidal sides edges, the frusto-conical hoops, being arranged back-to-back conform more to a spherical shape and the sinusoidal side edge troughs permitting hoops to interweave more tightly at cross-overs;

separating each pair of hooped strips (2) by an additional hoop (3) formed of an elongate, narrow, flat and straight-side edged strip of plastics material, the additional hoop being inserted centrally between the opposed side edges (6) of each hoop pair thereby to force each hoop pair apart to tighten the weave of the ball.

The outer faces (8) of the side (2) and central (3) strips may be grooved (12) to lend elasticity to the plastics strip material and to control the weight of the ball. Each side strip is holed (16,17,) at each end with one end of the strip having a depression (15) in the outer face (8) shaped to accommodate the other strip end and enable an essentially flush surface joint to be formed when the ends have been pop riveted together. The inner face of each strip is preferably plain.

By this method, when formed into a hoop, the side strip (3) would preferentially bend in the trough regions (7), where the strip is weakest (more flexible), this results in a polygonally-shaped hoop (2) being formed (see FIG. 5), the peaks (6) tending to be longitudinally flat and the troughs (7) longitudinally angled. This results in an irregularly shaped ball, as shown by FIG. 6, as can be seen the strip peaks (6) tend to remain flattened after weaving; leaving side-strip peaks (6) not conforming to the shape of the underlying side strip trough (7).

To overcome this irregularity, the side strips have been pre-formed by bending, kinking, the peak regions (6) as shown in FIG. 7, in a separate process prior to weaving. When formed into a hoop (2), these pre-bent peaks (6) compensate for the troughs (7); resulting in the more evenly circular hoop shown in FIG. 8 with the peaks (6) more acutely angled than the troughs (7). The resulting woven ball is shown by FIG. 9 to be more evenly spherical than the ball of FIG. 6 as the result of the peaks being longitudinally angled (of the strip), as opposed to being flattened.

Document WO 95/28206 (26 Oct. 1995—Satian Industries Co. Ltd.) describes a takraw ball woven from strips of composite material of which one part is of soft material and the other part of woven material; generally component parts are arranged and the strips are so woven that the outer surface of the ball is soft.

Document WO 2006/051248 (18 May 2006—Satian Industries Co. Ltd.) describes a takraw ball woven from strips of springy material having soft material pads moulded into recesses in a strip outer face.

STATEMENT OF INVENTION

A takraw ball side strip in accordance with the present invention and embodiments thereof are set forth in the appended claims.

A side strip in accordance with the present invention bends more readily in peak regions than in trough regions whereby the hooped side strip is more nearly circular than prior art hooped side strips. A takraw ball woven from side strips in accordance with the present invention is more spherical than prior art balls as the peak regions are rounded, not flattened or angular.

Also, a side strip in accordance with the present invention eliminates one manufacturing step, thereby improving economy and providing an improved takraw ball.

In an embodiment, an inner face of the side strip is relieved in the peak region to provide more flexibility.

BRIEF DESCRIPTION

Figure 1:
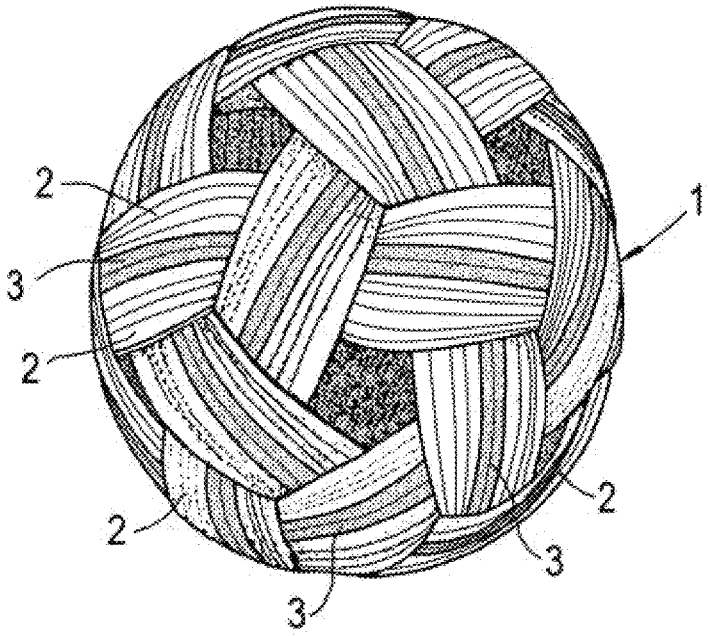
Fig.1 PRIOR ART
FIGS. 1-6 show examples of the prior art.
Figure 2:
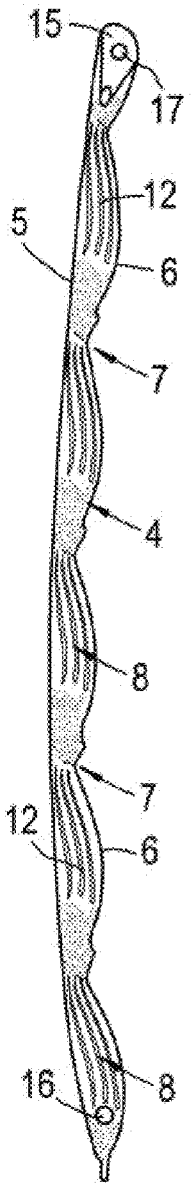
Fig.2 PRIOR ART
Figures 10, 11:
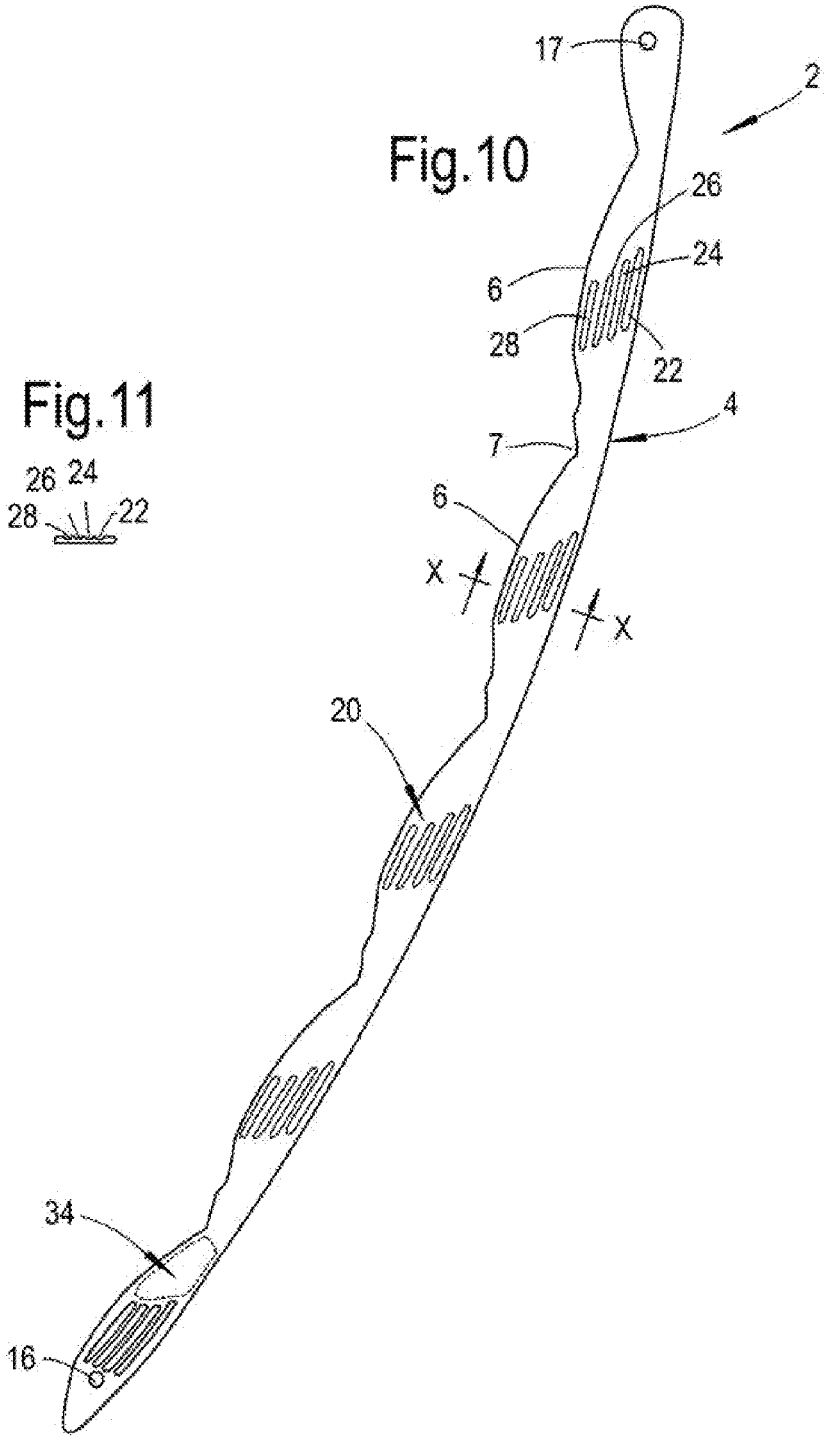

The above and further features of the present invention are illustrated in the Drawings, wherein:

FIG. 10 is an underplan of a takraw ball side strip in accordance with an embodiment of the present invention;

FIG. 11 is a section on the line X-X of FIG. 10

Figure 12:
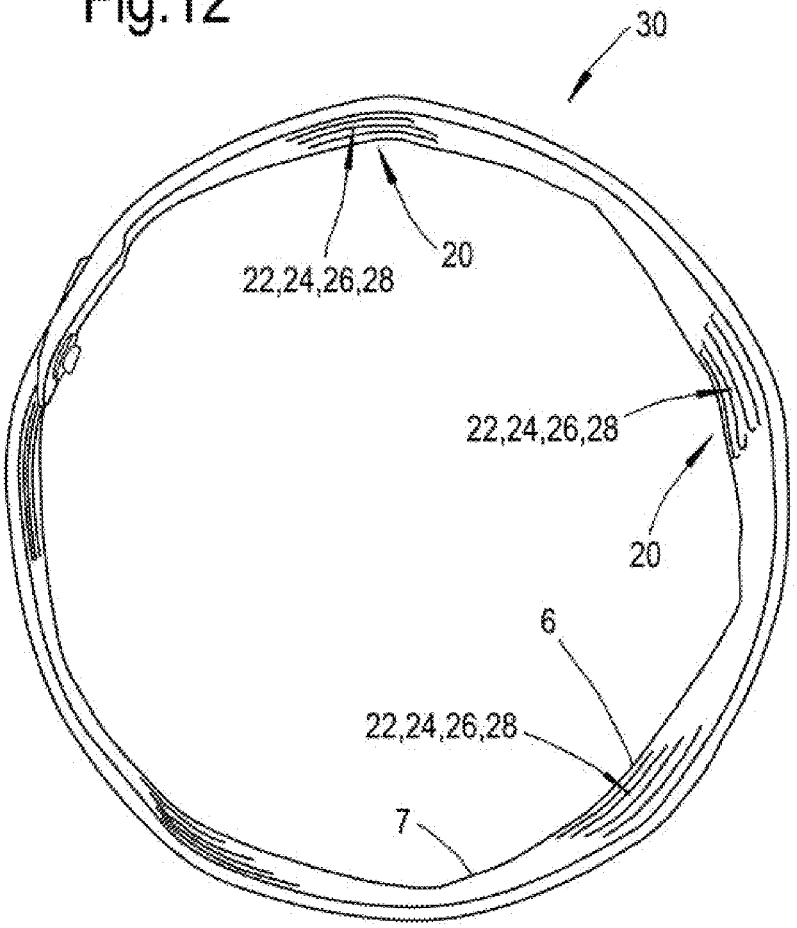
Figure 13:
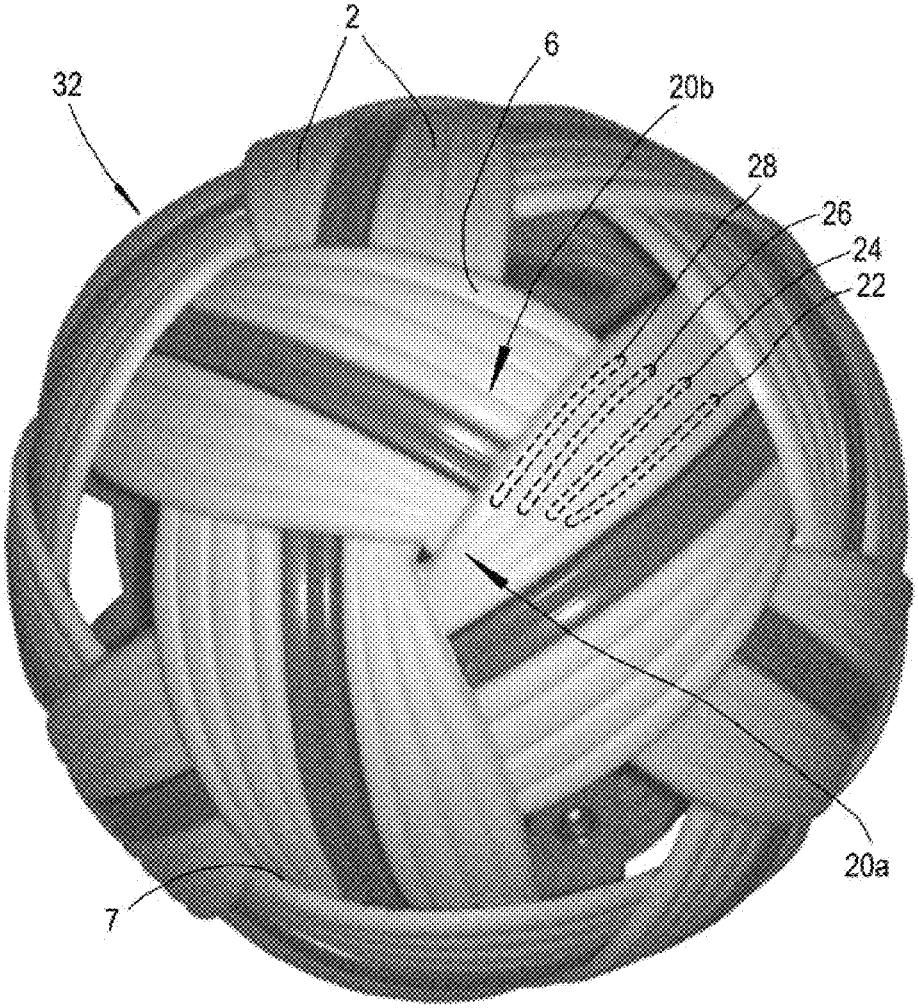

FIG. 12 is an underplan of a hoop formed from the side strip of FIG. 10; and, FIG. 13 is a perspective view of a takraw ball woven from side strip as illustrated in FIG. 10.

DETAILED DESCRIPTION

Figure 3:
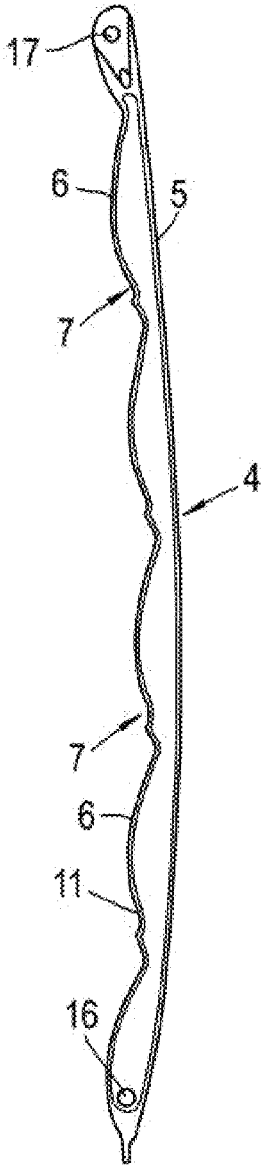
Fig.3 PRIOR ART
Figure 4:
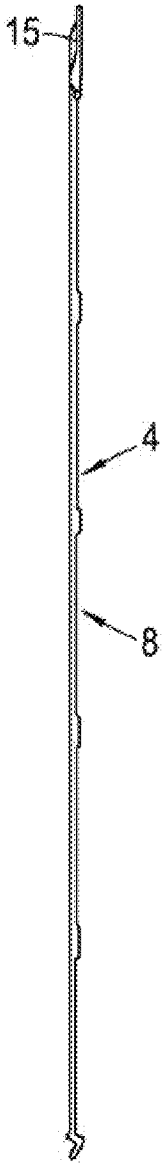
Fig.4 PRIOR ART
Figure 5:
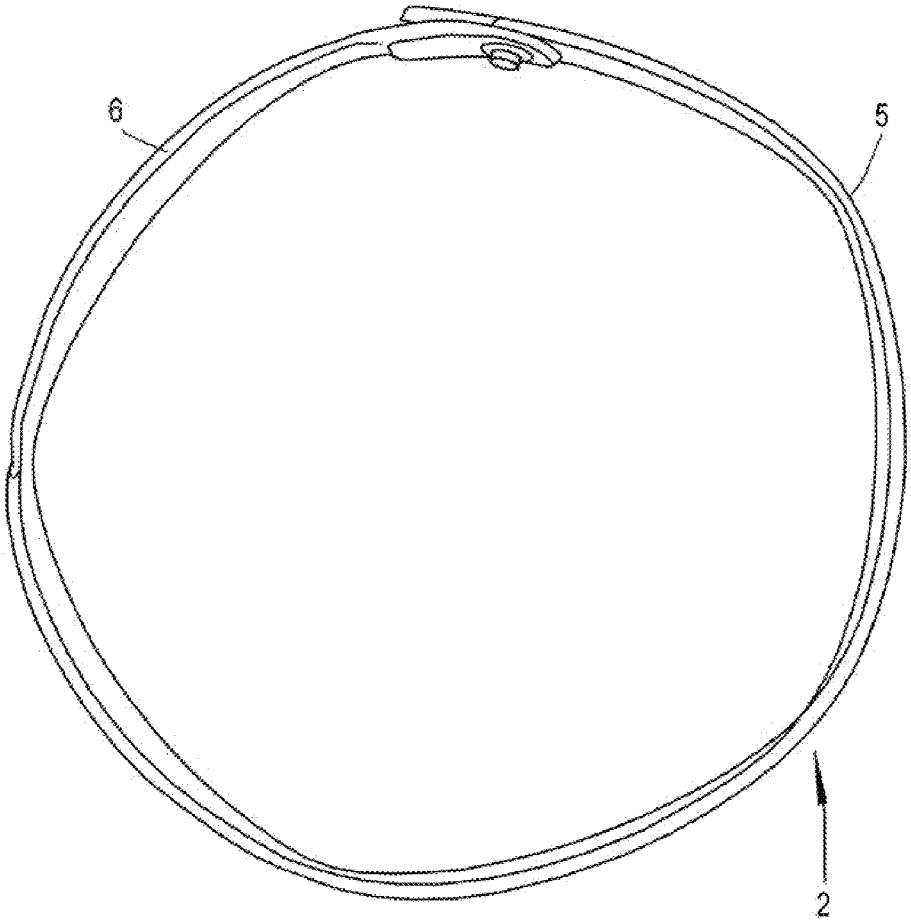
Fig.5 PRIOR ART

The side strip (2) shown in FIG. 10 is generally similar to the side strip shown by FIG. 3 and like parts have been given like references. The inner face of that region of the strip bounded on one side by a peak (20), hereinafter "the peak region", is relieved by a series of staggered parallel grooves (22,24,26,28), shown in FIG. 11; the grooves are longitudinal of the strip and are in echelon, that is one groove is positioned behind and slightly offset to one side of the groove in front, with groove (22) closest to convex side edge (4) opposite the top of a peak (6) and groove (28) closest to the sinusoidal side edge adjacent a flank of a peak (6).

When riveted through holes (16,17) the thus-formed hoop (30) is shown by FIG. 12 to be generally circular with a smooth, non-angular, circular profile.

Figure 6:
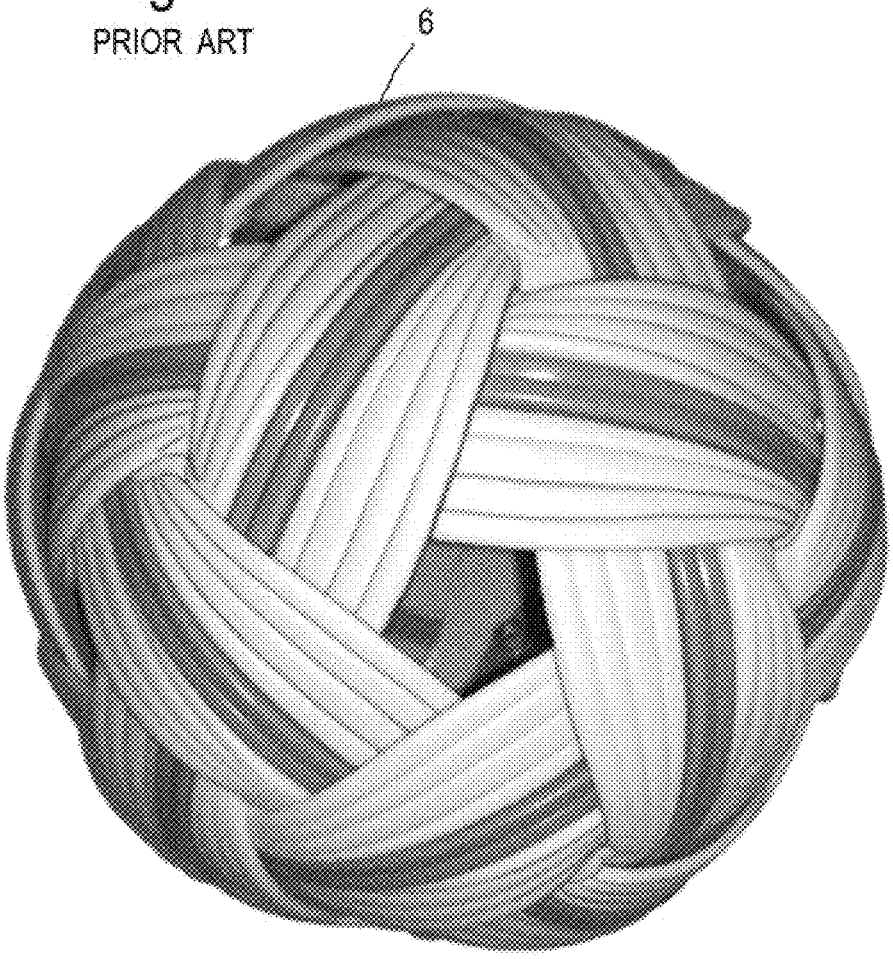
Fig.6 PRIOR ART
Figure 7:
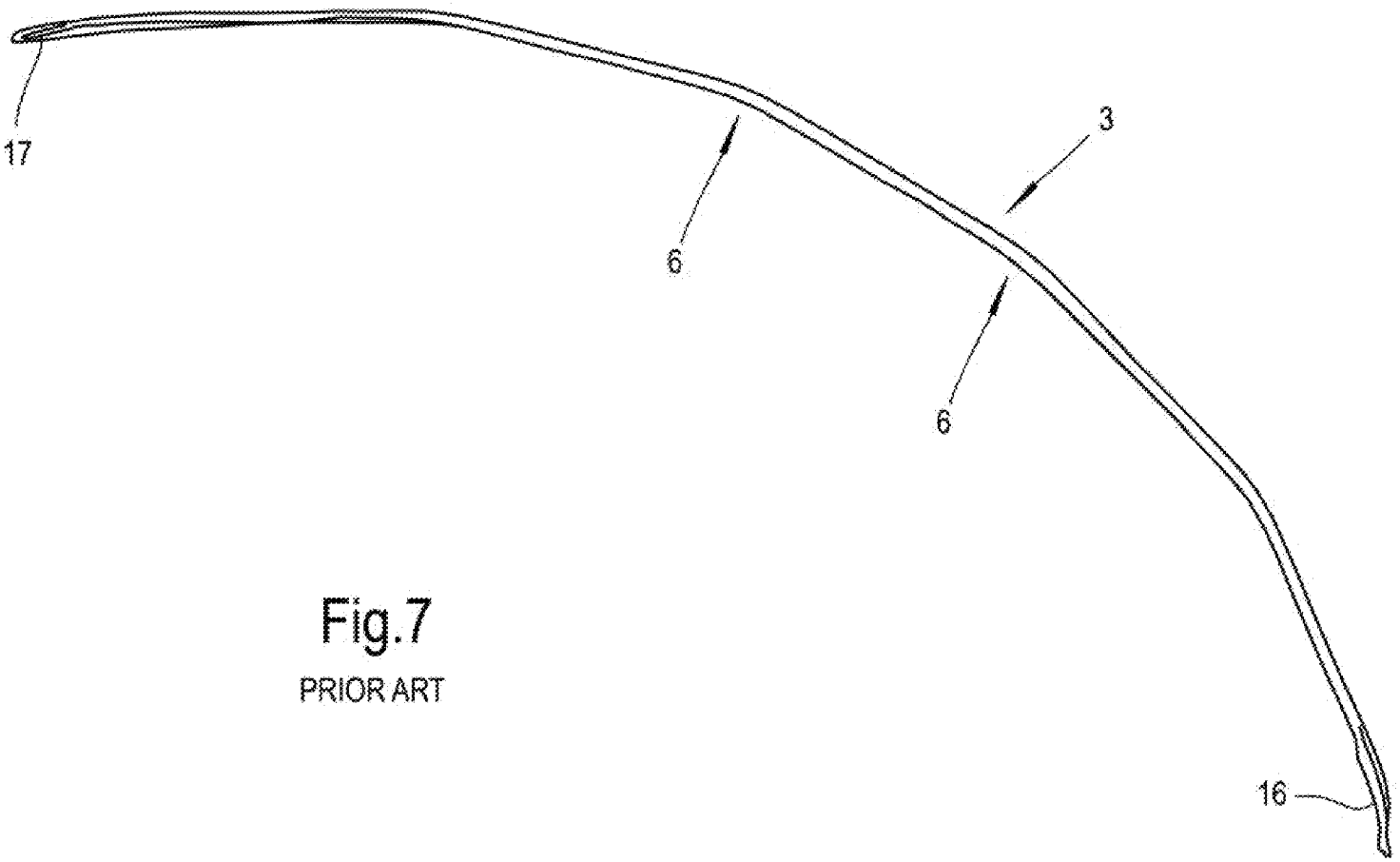
Fig.7 PRIOR ART
FIGS. 7-9 show an example embodiment of the invention.
Figure 8:
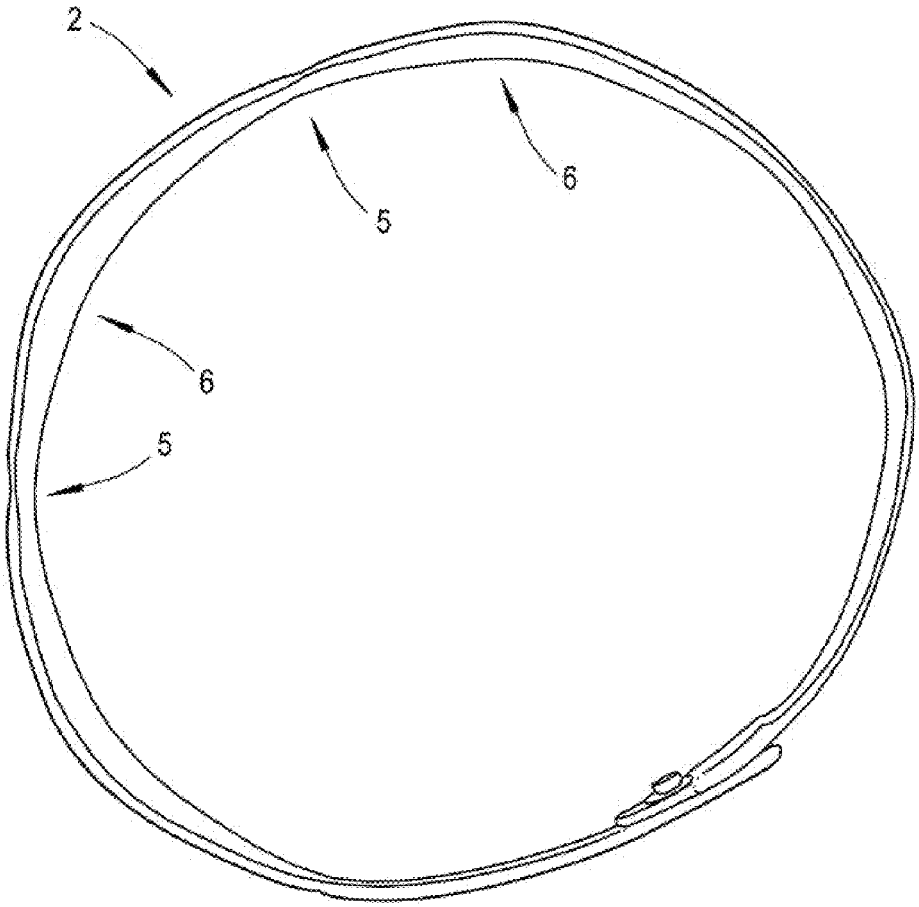
Fig.8 PRIOR ART
Figure 9:
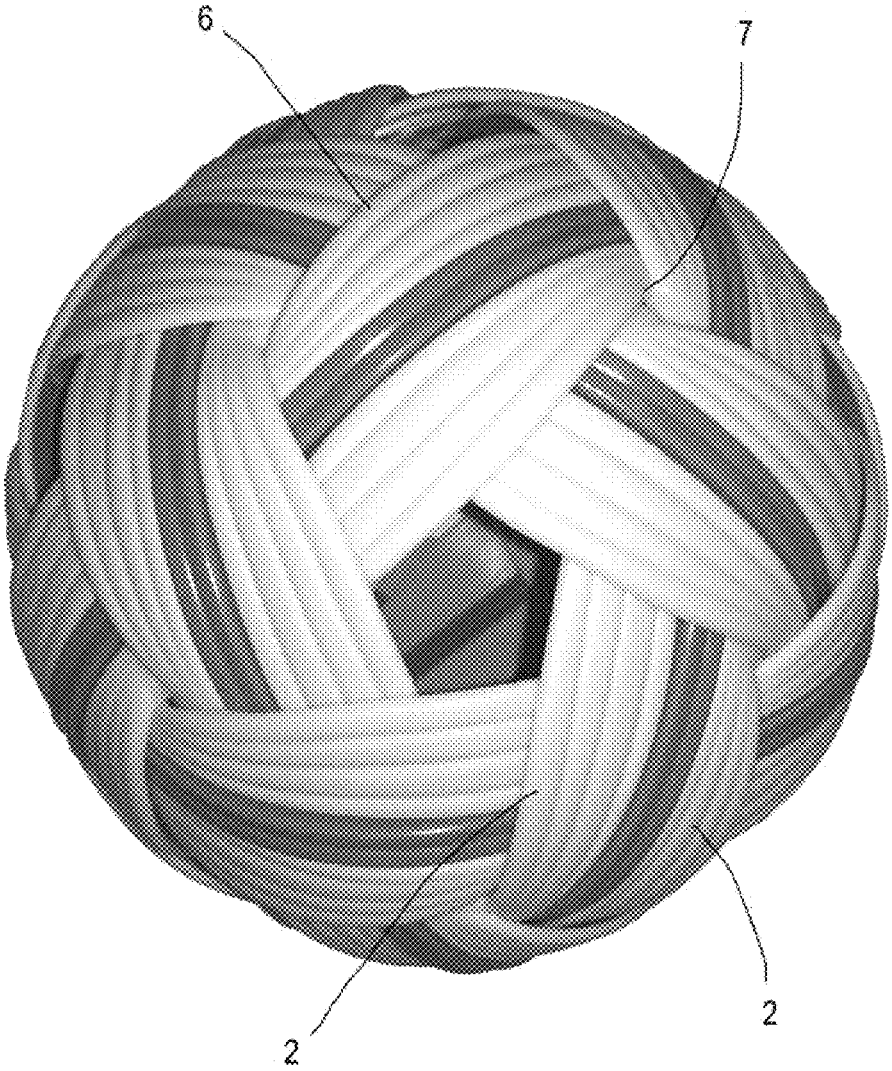
Fig.9 PRIOR ART

In the takraw ball (32) shown by FIG. 13 the grooves (22,24,26,28), indicated by dotted lines, overlie that strip region (34) extending from a peak (20) towards a trough (7). The effect of the grooves is that this peak region is preferentially flexible so that the peak region will bend more readily than other regions of the strip; such as the trough region. This results in the near circular hoop (2) shown by FIG. 12. When the ball has been woven, the more flexible peak region (20) of one strip (20*a*) overlies the less flexible trough region (34) of another strip (20*b*). This overlying peak region (20) of strip (20*a*) will mould, longitudinally and laterally, to better conform to the shape of the underlying, less flexible trough region of strip (20*b*); resulting in the ball shown in FIG. 13 having a spherical shape closer to that of a traditional rattan ball than that of either of the balls shown in FIG. 6 or FIG. 9.

Providing grooves to introduce more flexibility to the peak region leaves full strip thickness adjacent the strip edges; to maintain strength and durability. Other shapes or patterns of relief could be used, such as a trapezoidal recess replacing the grooves.

Side strips are moulded from plastics material and the peak region relief can be moulded along with other strip features.

The invention claimed is:

1. A takraw ball side strip comprising an elongate length of plastics material and having;

a first end;

a second end;

a side edge of sinusoidally undulating profile having troughs and peaks, and peak regions proximate said peaks of the side edge profile;

wherein the side strip is shaped or constructed to be preferentially flexible in said peak regions whereby, when said first end of the strip is joined to said second end to form a hoop, said peak regions will bend more readily than other regions of the strip.

2. A takraw ball side strip as claimed in claim 1 wherein the side strip has an inner face that is relieved in the peak region to provide more flexibility.

3. A takraw ball side strip as claimed in claim 2 wherein the relieving comprises grooves on said inner face of the side strip in said regions.

4. A takraw ball side strip as claimed in claim 3 wherein said grooves are a staggered parallel series aligned in echelon longitudinally of the strip.

5. A takraw ball side strip as claimed in claim 4 wherein;

the side strip has a convex side edge opposite to said side edge of sinusoidally undulating profile;

each said peak of the side edge of sinusoidally undulating profile has a flank and an apex;

the grooves are arranged in groups spaced longitudinally of the side strip, and wherein the groove in each group closest to the convex side edge is opposite a said apex and that groove in each group closest to the side edge of sinusoidally undulating profile is proximate a said flank of a said peak.

6. A takraw ball as claimed in claim 5 wherein the convex side edge of the side strip is of constant radius.

7. A takraw ball woven from side strips as claimed in any of claims 1 to 6.

8. A takraw ball as claimed in claim 7 wherein a said preferentially flexible peak region of one said side strip is positioned to overlie a less flexible region of an underlying of another said side strip.

* * * * *